US008803689B2

(12) United States Patent
Berger

(10) Patent No.: US 8,803,689 B2
(45) Date of Patent: Aug. 12, 2014

(54) OVER-THE-DOOR PRESSURE SENSOR ANTI-LIGATURE AND ALARM SYSTEM

(75) Inventor: Mark J. Berger, New York, NY (US)

(73) Assignee: Securitech Group, Inc., Maspeth, NY (US)

( * ) Notice: Subject to any disclaimer, the term of this patent is extended or adjusted under 35 U.S.C. 154(b) by 259 days.

(21) Appl. No.: 12/856,811

(22) Filed: Aug. 16, 2010

(65) Prior Publication Data

US 2011/0068927 A1 Mar. 24, 2011

Related U.S. Application Data

(60) Provisional application No. 61/274,333, filed on Aug. 14, 2009.

(51) Int. Cl.
*G08B 23/00* (2006.01)

(52) U.S. Cl.
USPC ..... 340/573.1; 340/666; 340/665; 340/539.1; 340/545.6; 200/61.43; 200/86 A; 200/85 A; 292/341.16; 292/340; 292/144

(58) Field of Classification Search
USPC ..... 340/666, 665, 668, 545.6, 545.7, 539.1; 200/85 R, 61.43, 85 A, 83; 292/341.16, 292/341.14, 340, 144, 254
See application file for complete search history.

(56) References Cited

U.S. PATENT DOCUMENTS

| | | | | |
|---|---|---|---|---|
| 1,832,905 | A | | 11/1931 | Jacobson |
| 3,315,050 | A | | 4/1967 | Miller |
| 3,754,176 | A | | 8/1973 | Miller |
| 4,115,952 | A | | 9/1978 | French |
| 4,396,814 | A | | 8/1983 | Miller |
| 4,620,072 | A | | 10/1986 | Miller |
| 4,763,110 | A | | 8/1988 | Zucker |
| 4,855,716 | A | | 8/1989 | Jordal |
| 4,920,241 | A | * | 4/1990 | Miller ..... 200/86 R |
| 4,987,277 | A | | 1/1991 | Duhon |
| 5,012,455 | A | | 4/1991 | Schwarz et al. |
| 5,066,835 | A | * | 11/1991 | Miller et al. ..... 200/61.43 |
| 5,083,110 | A | | 1/1992 | Ahrens |
| 5,382,945 | A | | 1/1995 | Novak |
| 5,418,342 | A | | 5/1995 | Miller |

(Continued)

OTHER PUBLICATIONS

"Cary's BMW Homepage," Internet article, anonymous, http://web.archive.org/web/20031006011318/http://bmwdude.home.mindspring.com/, Oct. 6, 2003.

(Continued)

*Primary Examiner* — Benjamin C Lee
*Assistant Examiner* — Chico A Foxx
(74) *Attorney, Agent, or Firm* — Abelman, Frayne & Schwab

(57) ABSTRACT

Apparatus for counteracting a suicide attempt of a person trying to hang himself from a cord extended over the top edge of a door which door has an inside upper surface facing the interior of the room, the apparatus including an elongated pressure sensor mountable on that inside upper surface of the door, the sensor having an exposed surface facing away from the inside surface of the door, that exposed surface being responsive to a force applied thereagainst by a segment of a cord when it is draped over the top of the door and hanging downward adjacent the inside surface, and the apparatus being adapted to forward an alarm signal indicating the sensing of the force by the cord, and an electrical controller to forward an alarm signal indicating that the sensor has sensed the downward force.

13 Claims, 6 Drawing Sheets

(56) References Cited

U.S. PATENT DOCUMENTS

Figure 1:
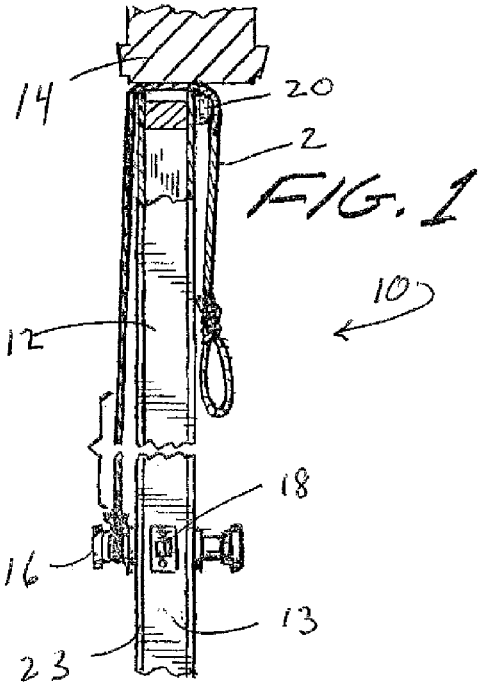

| | | | | |
|---|---|---|---|---|
| 5,434,557 | A | 7/1995 | Alizi | |
| 5,444,440 | A | 8/1995 | Heydendahl | |
| 5,474,342 | A * | 12/1995 | Smith et al. | 292/254 |
| 5,950,255 | A | 9/1999 | Thompson | |
| 5,957,612 | A | 9/1999 | Bradley | |
| 5,962,825 | A | 10/1999 | Miller | |
| 6,040,536 | A * | 3/2000 | Miller et al. | 200/83 N |
| 6,172,315 | B1 | 1/2001 | Miller et al. | |
| 6,297,605 | B1 | 10/2001 | Butler et al. | |
| 6,380,851 | B1 | 4/2002 | Gilbert et al. | |
| 6,515,586 | B1 | 2/2003 | Wymore | |
| 6,581,991 | B2 * | 6/2003 | Galindo | 292/341.16 |
| 6,896,268 | B2 | 5/2005 | Hofmann et al. | |
| 7,234,755 | B1 | 6/2007 | Senn | |
| 7,466,237 | B1 * | 12/2008 | Cook | 340/665 |
| 7,999,690 | B1 * | 8/2011 | Shilts | 340/666 |
| 2008/0026686 | A1 | 1/2008 | Marmosh | |
| 2008/0043933 | A1 | 2/2008 | Pinault et al. | |

OTHER PUBLICATIONS

Recora Incorporated, Specializing in Custom-Design applications to suit individual requirements, webpage http://recora-co.com.

* cited by examiner

OVER-THE-DOOR PRESSURE SENSOR ANTI-LIGATURE AND ALARM SYSTEM

CROSS-REFERENCE TO RELATED APPLICATIONS

This application claims priority under 35 U.S.C. §119, 120 and/or 365 on Provisional Application Ser. No. 61/274,333 filed Aug. 14, 2009.

A. BACKGROUND OF THE INVENTION

I. Field of the Invention

This invention relates to a serious problem where certain patients in psychiatric institutions try to commit suicide by hanging themselves with cords looped over the tops of doors to their rooms; the invention pertains to methods and apparatus seeking to prevent such attempted suicides.

II. Background and Prior Art

It is known that certain patients in psychiatric institutions try to commit suicide by various different means. Reasons for such behavior are complex and not the subject of the present invention; however, significant numbers of suicide attempts do occur, and significant numbers of patients are committed into these institutions for the very reason that they are known to be candidates for suicide attempts and these institutions are supposed to be environments for treatment of these and other problems and for prevention of patients from achieving suicide.

While the methods employed for the attempted suicides vary with the available environment and the creativity of the patients, the present invention is concerned with suicide attempts by hanging with a cord where the patient forms the distal or remote end of the cord into a knot or other enlargement, then drapes the cord over the top of his or her door with the knot on the far side, and then closes the door which restrains the distal end. The near or proximal end of the cord is used in the expected way about the patient's neck.

In typical psychiatric institutions the patients' activities, as regards personal safety and behavior in general, are monitored carefully by staff; however, it is also common for patients to have private rooms with unlocked doors for them to come and go generally as they please. It is in these kinds of situations where a patient has periods of relative privacy and domain over his or her door, when a suicide attempt can be made without immediate awareness by institution staff, and with enough time for the suicide to be successful before staff action can be taken. For various reasons there are surprisingly high numbers of attempted and successful suicides in mental institutions that are not generally publicized or known, but administrators of these institutions are quite aware and concerned. The present invention addresses these tragedies and presents a practical apparatus believed to be able to significantly reduce the problem on a nationwide basis.

Prior art documents such as U.S. Pat. Nos. 4,893,854 and 4,186,954 and 4,005,890 disclose known structures of door latch assemblies, particularly including door strike plates and latch bolts.

B. OBJECTS AND SUMMARY OF THE NEW INVENTION

A first object of the present invention is to provide a method and apparatus to counteract suicide attempts and thus to reduce the incidence of successful suicides in psychiatric institutions, where the suicide is by hanging with a cord draped by a patient over the door in his or her room, with the distal or remote end of the cord either wedged between the top of the door and the door frame when the door is closed or with the distal end of the cord enlarged as with a knot and restrained on the far side of the door when the door is closed into its door frame.

Another object of this invention is to provide a sensor near the top of the door, which sensor will sense any pressure caused by a cord draped over the top of the door and pulled downward by the weight of the patient's body. Such a sensor will be chosen from a variety of commonly available devices, including, for example, a tubular sensor containing resiliently spaced apart strips which close an electrical, electronic, magnetic or other circuit when the two strips are pressed together at any location along their length. Pressure by a cord draped anywhere along the top edge of the patient's door will trip a circuit which sends an appropriate signal to an alarm system. In a separate embodiment the above described device has the additional feature to also automatically unlatch the door if the alarm system has been actuated by pressure from a cord at the top of the door. The unlatched door will then tend to open in the inwardly direction from the pull of the cord on the interior room side of the door by the suicide cord, and such opening movement of the door would immediately release the distal end of the cord and defeat the suicide attempt. Simultaneously, the alarm signal would be directed to hospital staff, but the released door would defeat the suicide attempt even before the staff arrived.

An additional object of the present invention is provide the above described apparatus in a design form that can be installed in standard doors commonly used in a great many buildings which would include many psychiatric institutions all over the country.

It is a further object that installation of the new pressure sensor apparatus onto a door can be easily done in factories at time of initial door manufacture, and can also be done as a retrofit onto existing doors wherever they may be. Obviously, it is a still further object that such installation be reasonably simple and reasonable in cost and be reliable in use. It is expected that the retrofit procedure will be relatively easy without reconstruction or even partial disassembly of original doors.

Another object of this invention is to provide both an alarm signal immediately when a suicide is being attempted and an immediate physical intervention against the suicide attempt by the cord release apparatus even before there is response by institution staff to the alarm.

A still further additional object is to provide apparatus that is non-obtrusive in appearance, so that it will not attract the patient's attention, and is located at the top of the door where it will not be vulnerable to tampering.

Still further embodiments include the unlatch assembly described above and a method of employing this assembly.

The present invention relates particularly to apparatus to sense an attempted suicide and to prevent the patient from succeeding in such effort.

Exemplary embodiments of the present invention are described as:

1. Apparatus for counteracting a suicide attempt of a person trying to hang himself from a cord extended over the top edge of a door which door is mounted in a door frame in a room, where said door has a top edge facing upward, a latching edge, an inside surface facing the interior of said room with an upper portion thereof generally adjacent said top edge, an opposite outside surface, and a latch assembly with a latch bolt extendible outward of said latching edge, and said frame includes a strike plate for cooperation with said latch bolt, said apparatus comprising:

a. an elongated pressure sensor mountable on said inside surface at said upper portion thereof, said sensor having an exposed surface facing away from said inside surface, said exposed surface (i) being responsive to force applied thereagainst by a segment of a cord when draped over said top of said door and hanging downward adjacent said inside surface, and (ii) being adapted to forward a signal indicating the sensing of said force by said cord, and b. an electrical controller with circuit means adapted to receive said signal from said sensor indicating that a downward force has been applied by said cord, and in response to receiving said signal to forward an alarm signal indicating that said sensor has sensed said downward force.

2. Apparatus according to claim 1 wherein said pressure sensor comprises a tubular body, and electrical circuit means, said tubular body containing a pair of electrical contact strips which have a normal spaced apart relationship with at least one being movable to contact the other to close said electrical circuit with a resulting signal being sent to said controller.

3. Apparatus according to claim 1 wherein said pressure sensor is situated at an elevation below said top edge of said door.

4. Apparatus according to claim 1 wherein said pressure sensor extends transversely away from said inside surface.

5. Apparatus according to claim 1 where said pressure sensor has an outer contact surface that faces upward and inward relative to said inside surface of said door.

6. Apparatus according to claim 1 wherein said pressure sensor has an upper surface that extends no higher than said top edge of said door.

7. Apparatus according to claim 1 wherein said pressure sensor has an external contact surface with normal position and an activated position that is inward or downward from said normal position, and spring means for resiliently urging said external contact surface forward of said normal position.

8. Apparatus for counteracting a suicide attempt of a person trying to hang himself from a cord extended over the top edge of a door which door is mounted in a door frame in a room, where said door has a top edge facing upward, an inside surface facing the interior of said room with an upper portion thereof generally adjacent said top edge, and an opposite outside surface, said apparatus comprising:

a. a door including a latch assembly and its latch bolt, b. a frame including a strike plate into which said latch bolt is moveable to latch said door, c. an unlatch unit mountable in said door frame and adapted to push said latch bolt out of said strike plate when said latch bolt extends in its locked position into said strike plate, and d. an elongated pressure sensor mountable on said inside surface at said upper portion thereof, said sensor having an exposed surface facing away from said inside surface, said exposed surface (i) being responsive to force applied thereagainst by a segment of a cord when draped over said top of said door and hanging downward adjacent said inside surface, and (ii) being adapted to forward a signal indicating the sensing of said force by said cord, and e. an electrical controller with circuit means adapted to receive said signal from said sensor indicating that a downward force has been applied by said cord, and in response to receiving said signal to forward an alarm signal indicating that said sensor has sensed said downward force, and (ii) to direct said latch assembly to push said latch bolt out of said strike plate so that said door can open.

9. Apparatus according to claim 8 wherein said unlatch unit comprises a housing mountable in said door frame adjacent said strike plate, and an electrically powered drive unit in said housing and electrically coupled to said circuit means for pushing said latch bolt out of said strike plate when said controller receives said signal from said sensor.

10. Apparatus according to claim 9, further comprising a drive unit adapted to push said door open relative to said door frame after said controller has caused said unlatch unit to unlatch said door lock.

These and other objects and advantages of the invention will be further understood and appreciated by those skilled in the art by reference to the following written specification, claims and appended drawings.

C. BRIEF DESCRIPTION OF THE DRAWINGS

Figure 2:
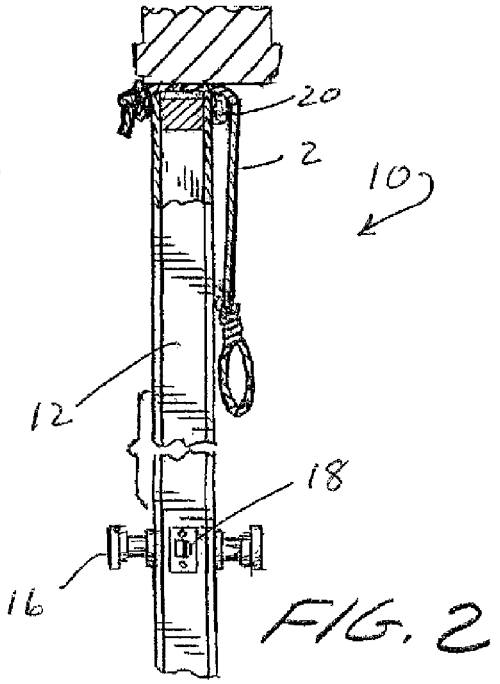
Figure 3:
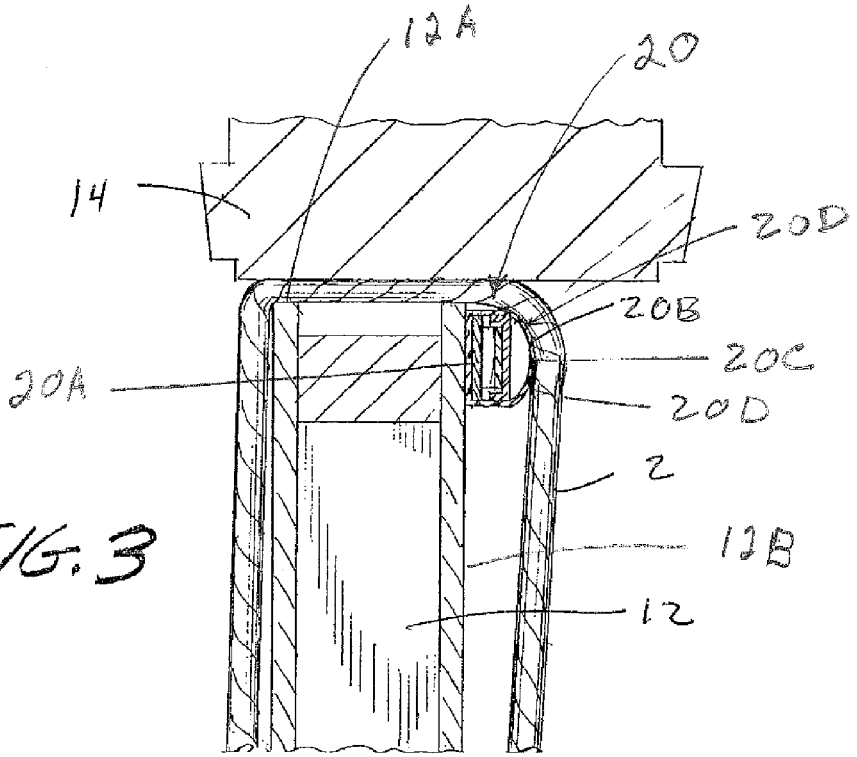

FIG. 1 is a fragmentary front elevation view of a first embodiment of the present invention showing a door, a cord for an attempted suicide draped over said door and a pressure sensor on the inside surface of the door with the distal end of the cord restrained by engagement to the door handle, FIG. 2 is similar to FIG. 1 but has the distal end of the cord restrained by the adjacent edges of the door frame and the door, FIG. 3 is an enlargement of a portion of FIG. 1

Figure 4:
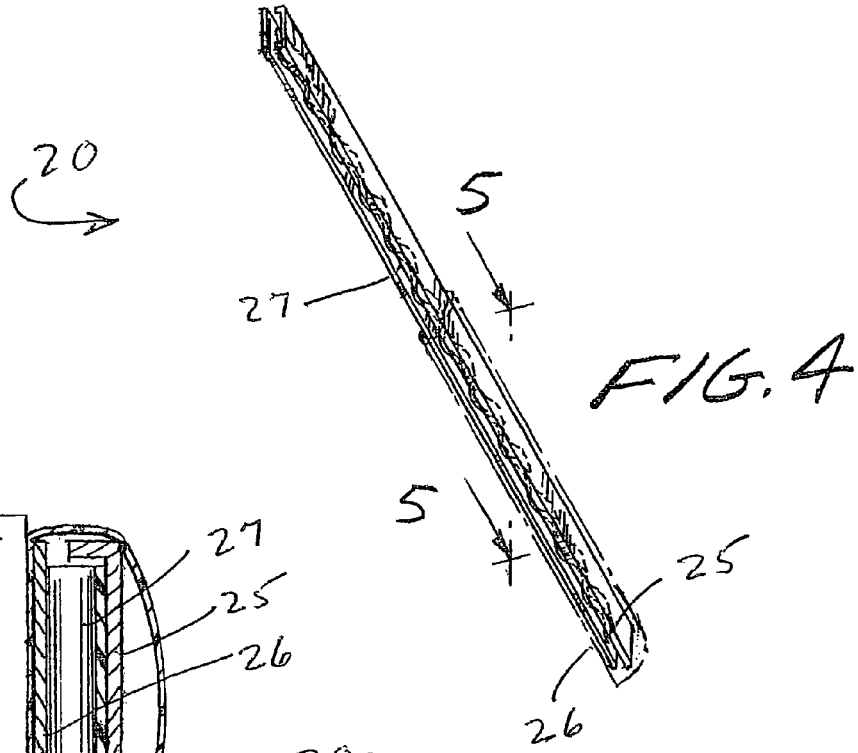
Figure 5:
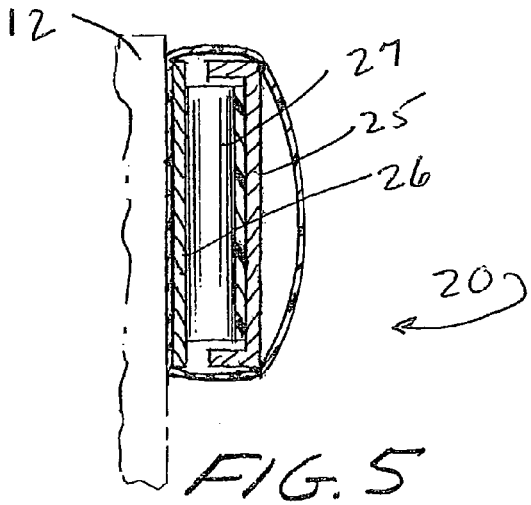
Figure 6:
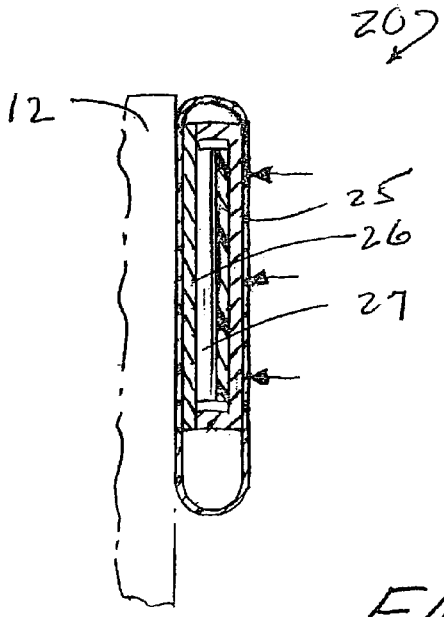
Figure 7:
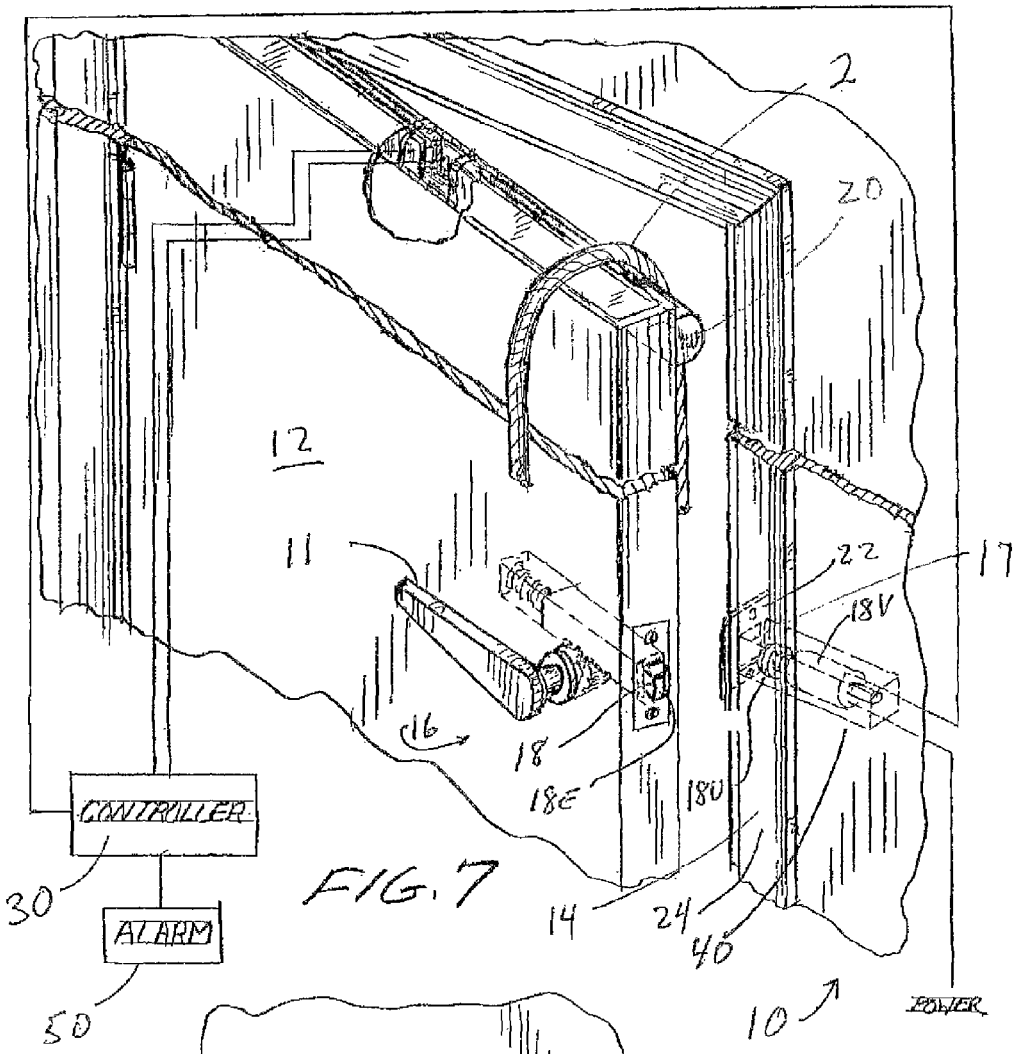
Figure 8:
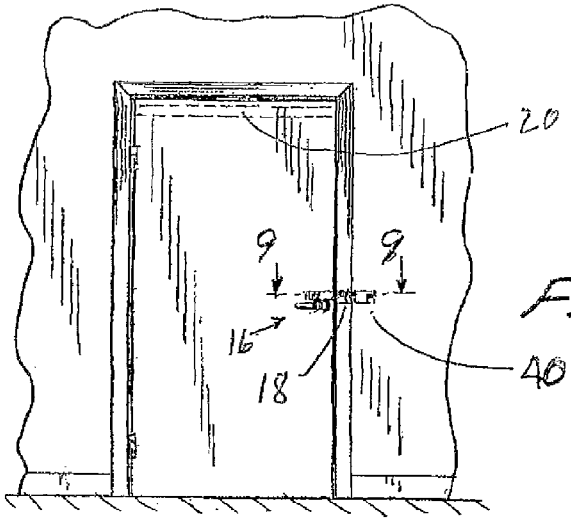
Figure 9:
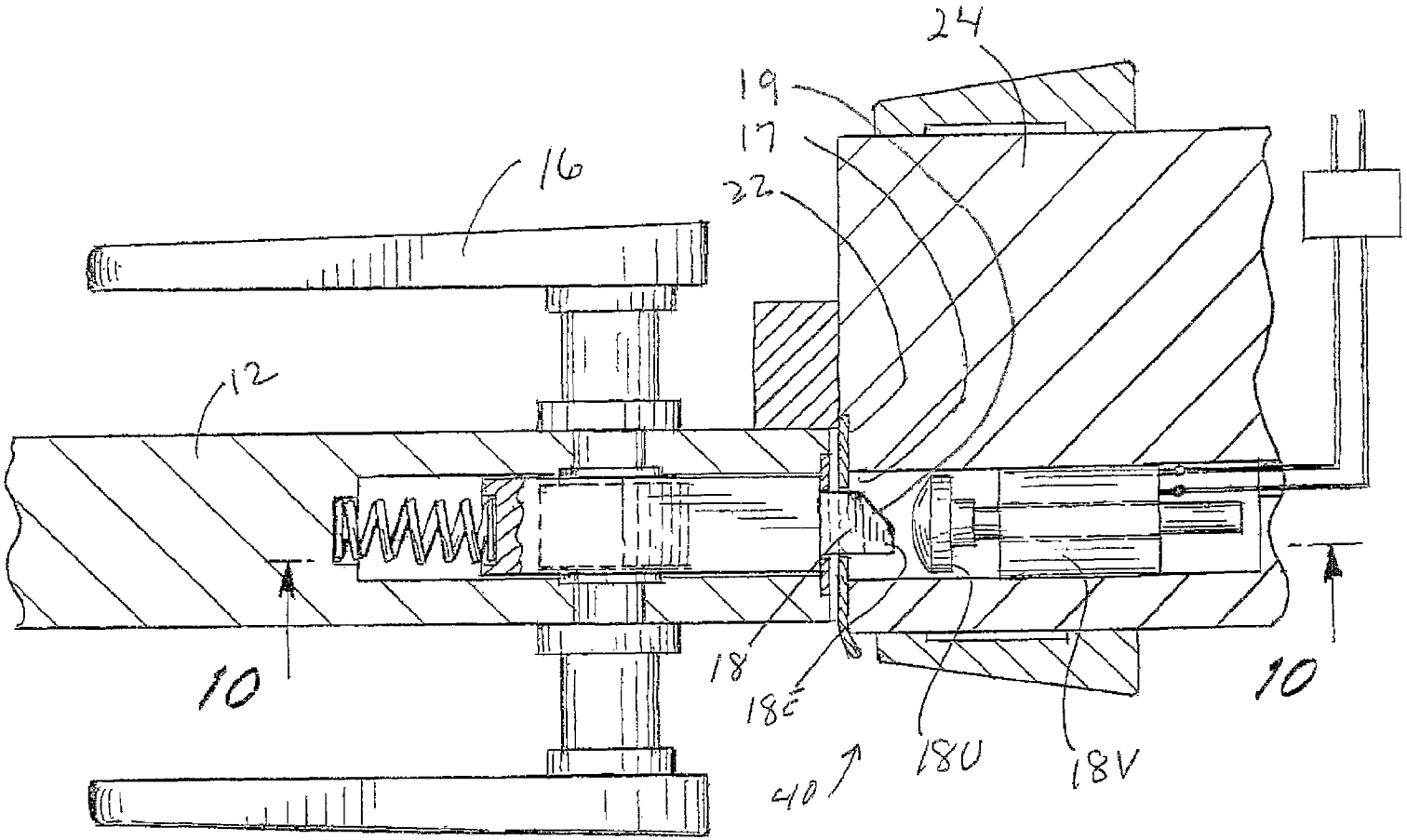
Figure 10:
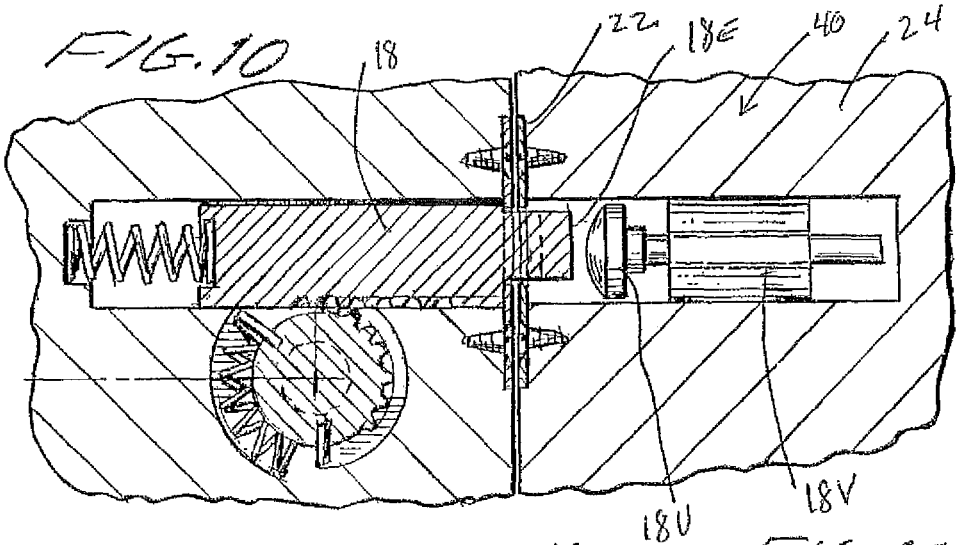
Figure 11:
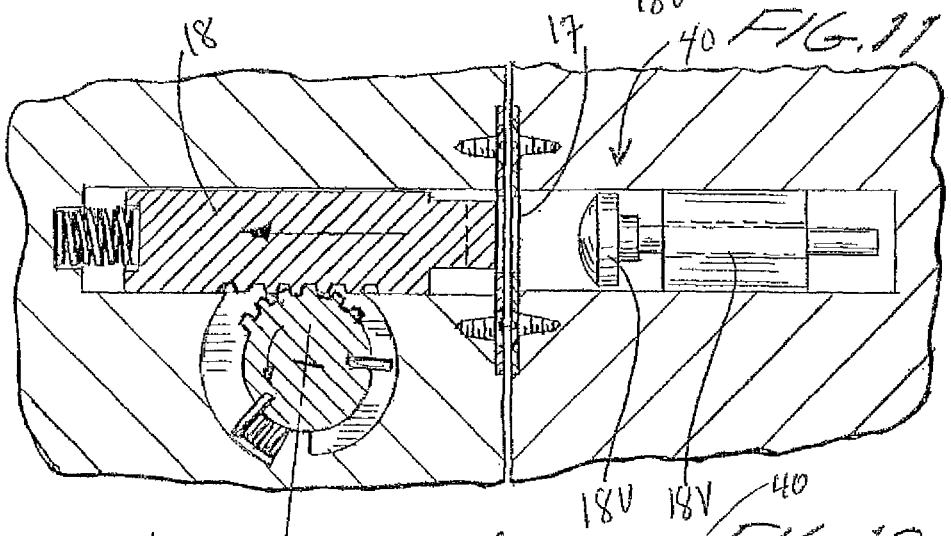
Figure 12:
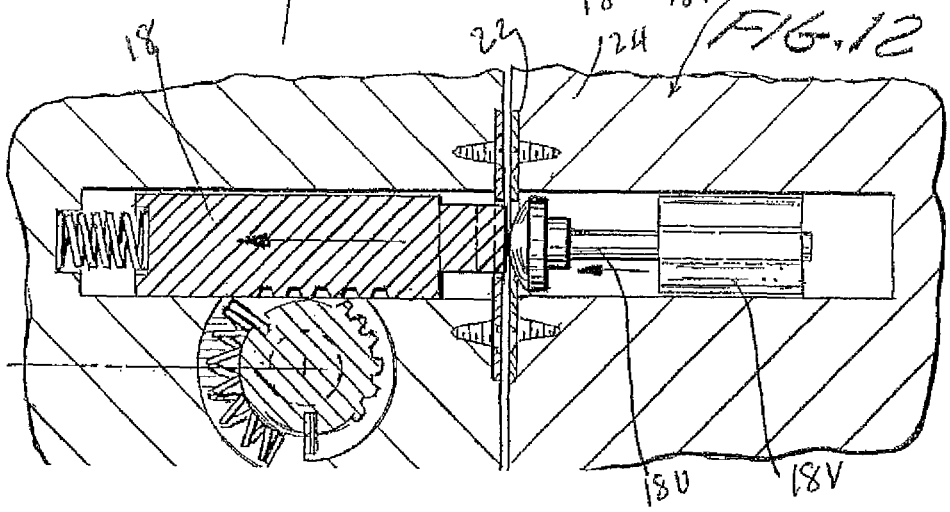
Figure 13:
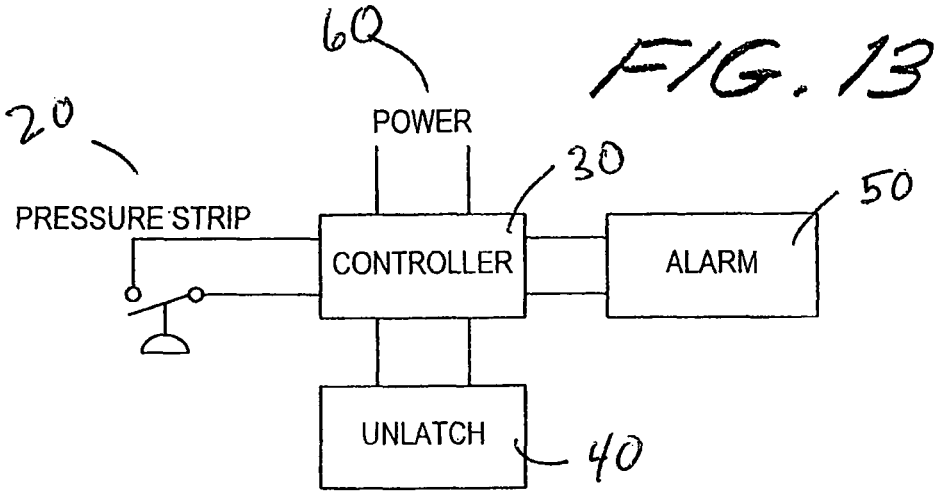
Figure 14:
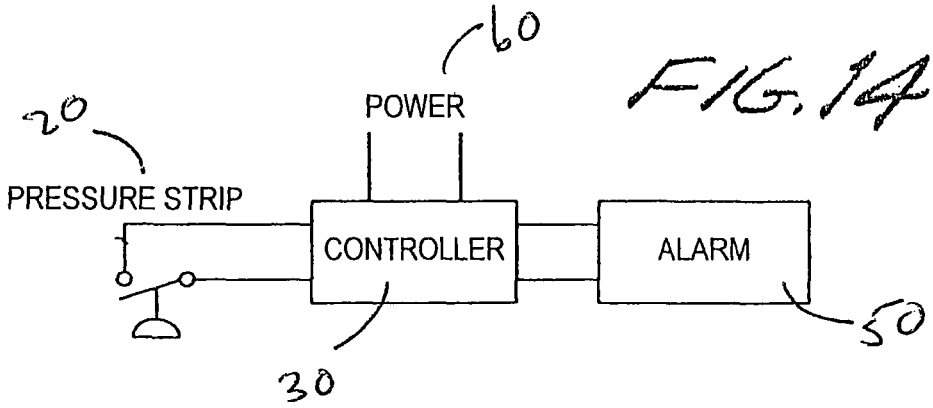
Figure 15:
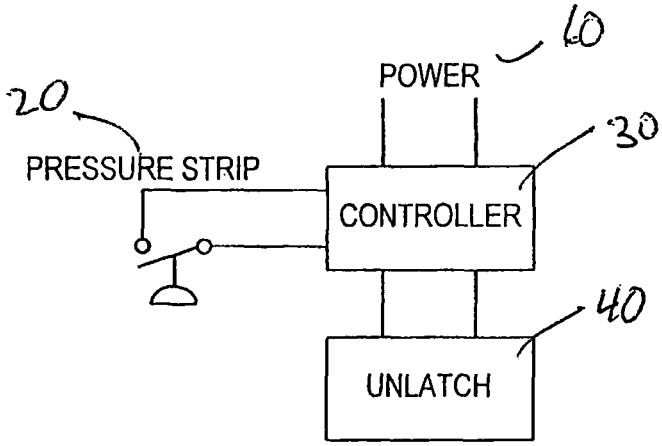

FIG. 4 is an enlarged perspective view of the pressure sensor strip of FIG. 11, FIG. 5 is an enlarged sectional view taken along line 9-9 in FIG. 8 with the pressure sensor strip in its normal uncompressed state, FIG. 6 is a sectional view similar to FIG. 9, showing the pressure sensor strip in its compressed state, FIG. 7 is a fragmentary top front perspective view this invention similar to FIG. 1 in combination with an unlatch unit mounted in the door frame, FIG. 8 is a fragmentary elevation view showing the door of FIG. 7 closed in the door frame, FIG. 9 is a fragmentary enlarged top plan view in section taken along line 9-9 of the door and door frame of FIG. 8, FIG. 10 is a fragmentary side elevation view showing the latch bolt engaged in the strike, FIG. 11 is an elevation view similar to FIG. 10, showing the bolt retracted from the strike because of rotation of the door handle, FIG. 12 is an elevation view similar to FIG. 10, showing the bolt retracted due to action of the unlatch device, FIG. 13 is a schematic electrical circuit diagram of the system in FIGS. 1 and 2, FIG. 14 is a schematic electrical circuit diagram similar to that of FIG. 13, but for activating the alarm and not the unlatch device, and FIG. 15 is a schematic electrical circuit diagram similar to that of FIG. 13, but for activating the unlatch device and not the alarm.

While the invention has been described in conjunction with several embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

D. DETAILED DESCRIPTION OF THE PREFERRED EMBODIMENTS

For convenience and clarity in describing these embodiments, similar elements or components appearing in different figures will have the same reference numbers.

FIGS. 1, 2 and 3 show a door in a door frame with the new over-the-door pressure sensor anti-ligature and alarm apparatus, FIGS. 4-6 show the pressure sensor alone, FIGS. 7-12 show the pressure sensor alarm system of FIGS. 1-3 combined with a door unlatch device, and FIGS. 13-15 show circuit diagrams for such systems.

As seen in FIGS. 1, 2, 7 and 9 the new over-the-door pressure sensor alarm system 10 is applicable to a standard door 12 and door frame 14 whether installed during original manufacture of the door at a factory or installed as a retrofit to a door already installed in a door frame. The door 12 includes a standard spring latch and lever handle 16 and bolt 18 with a tapered edge 19 (see FIG. 9) that enters aperture 17 in strike plate 22 in the vertical door jam 24 (see FIG. 7) for latching the door shut.

A. General Concept

As seen in FIGS. 1, 7 and 13-15 the new over-the-door pressure sensor anti-ligature and alarm system 10, employed in a standard door and door frame 12, 14, includes three basic components, namely:

(a) pressure sensor strip 20, (b) controller 30, and (c) alarm 50, electrically connected via circuit means to power source 60.

The pressure sensor 20 as seen in FIGS. 1-3, for example, has a base or bottom part 20A and an opposite outer part 20B. The door 12 as shown mounted in vertical orientation has a top edge 12A, an inside surface 12B that faces inwardly of a room when the door is closed. The sensor 20 as shown is mounted on said inside surface 12B of said door and is mounted at an elevation where the entire pressure sensor 20 is at an elevation below said top edge 12A of said door.

Further details of said pressure sensor 20 as seen in FIGS. 1-3 show that said outer part 20B has a curved outer surface, comprising a central portion 20C and opposite side portions 20D. The door 12 as shown mounted in vertical orientation has a generally flat planar inside surface 12B (see FIG. 3) that faces inwardly of a room when the door is closed. As seen, the top edge 12A of door 12 is closely adjacent the bottom surface of the header or top horizontal portion of the door frame 14. The sensor 20 as mounted on door 12 lies with its base part 20A generally parallel to and closely adjacent said planar inside surface 12B of said door, such that said central part 20C of said sensor 20 faces inwardly of said room.

FIGS. 7, 9-12, show this system with the additional unlatch device 40, and FIGS. 13 and 15 provide circuit diagrams therefore.

B. Summary of the Operation of the System

As seen in FIGS. 1-3 and 7, if a cord 2 is draped over the top edge of the patient's door 12 and pulled downward by the patient's weight in an attempted suicide, the cord applies downward pressure on the pressure sensor 20 which in turn emits a signal that is received by controller 30 (see FIGS. 7 and 13-15). The controller immediately sends a signal to activate alarm 50 (see FIGS. 7 and 13-15) to alert institution staff persons that a suicide attempt has been initiated. In the embodiment of FIGS. 7-12 this system sends a separate signal to activate unlatch device 40 to unlatch the door and defeat the suicide attempt by allowing the door to open which releases the remote end of the hanging cord. The patient will then fall to the floor, but strangling pressure on the neck will be eliminated.

C. The Pressure Sensor

As seen in FIGS. 1-3, the sensor 20 is secured on the inside surface near the top of a typical door 12 made of opposite exterior and interior panels 23I and 23E respectively about a core 13. Pressure sensor 20 is located at an elevation below the top edge of the door. Downward pressure of cord 2 seen in FIGS. 1 and 2 will partially compress pressure sensor 20 (see FIGS. 5 and 6), causing its outer contact 25 to move inward, engage inner contact 26, (see schematic FIGS. 4-6), and close the circuit, leading to the above-mentioned signals to alarm 50 and to unlatch device 40 (see FIG. 7).

Pressure sensor 20 may be selected from many commercially available sources, and in general includes outer and inner contact strips 25, 26, and an intermediate electrical insulation material generally preventing unintended electrical contact between said outer and inner contact strips 25, 26, and a resilient spring element 27 maintaining said outer and inner contact strips horizontally separated while allowing them to touch in selected places when downward pressure is applied. Finally, contact elements or areas on said outer and inner contact strips which when touched together close the electrical circuit for sending the alarm signal to controller 30. One commercially available sensor usable on this system is a strip form of "Presence sensing switch" made by Recora, Inc., Batavia, Ill. 60510 and viewable at its website recora-co.com.

A variety of alternate sensors may be used, including magnetic, electronic, hydraulic, etc., all of which respond to pressure and produce a signal adapted to activate a controller or other appropriate component.

FIG. 1 illustrates a situation where a patient ties the distal end of the cord 2 to the outside door knob, and FIG. 2 illustrates a situation where a patient creates an enlargement 3 at the distal end with a knot in cord 2 or an object tied onto the cord to restrain the distal end in a suicide attempt.

D. The Alarm

The alarm 50 is selected from any commercially available audible, light-flashing or other alarms that can adequately alert institution staff persons. In the embodiment shown herein, the alarm is a bell or siren electrically powered by the same power source that operates the circuit herein.

E. The Unlatch Device

As seen in FIGS. 7 and 9-12 the unlatch device 40 is mounted in a door jam 24 immediately behind strike plate 22 and aligned with latch bolt 18 extendable from the door latch into aperture 17 of the strike plate.

In normal operation of the latch when door is closed, bolt 18 will be spring biased to its extended state into strike plate 22, and door 12 will be restrained in its closed and latched state.

In operation of the new pressure sensor alarm unlatch system, bolt 18 will be automatically and quickly driven to its retracted state by unlatch bolt 18U which is driven axially by solenoid 18V or other selected drive means. Bolt 18 in the door is driven laterally a distance sufficient for its end 18E to clear strike plate 22, so that the door latch no longer restrains the door in its closed state.

As indicated in FIG. 7, upon application of downward pressure to the top of door 12 with a cord 2 pulling from a patient's neck, the door unlatch and release sequence will immediately begin, resulting in opening of the door so that the knot or other enlargement 3 (see FIG. 2) at the distal end will no longer be restrained, and the cord 2 will slip to the interior room side of the door, releasing the patient from the attempted suicide. In a further embodiment not shown, the unlatch device would include a second drive means mounted to the door jamb or to the door to push the door open after the unlatch device has released the bolt.

F. The Controller and Circuit Diagrams

The controller 40 primarily relays and/or converts an input alarm signal from sensor 20 to outputs which activate alarm 50 and activate unlatch device 40. In variations of this invention the controller can activate both the alarm 50 and the unlatch device as shown in FIG. 13, or can activate only the unlatch device as seen in FIG. 15, or can activate only the alarm, as seen in FIG. 14. In FIG. 13, for example, the circuit diagram components comprise pressure sensor 20, controller 30, unlatch device 40 and alarm 50, all powered from power source 60 which is typical 110 V line current. A signal from sensor 20 that suicide is being attempted is received by controller 30 which sends signals to activate alarm 50 and to activate unlatch device 40.

Although the preferred mode for carrying out the present invention has been described in the foregoing detailed description and illustrated in the accompanying drawings, it will be understood that the invention is not limited to the embodiments enclosed, but is capable of numerous rearrangements, modifications and substitutions of steps and elements without departing from the spirit of the invention. Accordingly, the present invention is intended to encompass such rearrangements, modifications and substitutions of steps and elements as falls within the scope of the appended claims.

The invention claimed is:

1. Apparatus for counteracting a suicide attempt of a person trying to hang himself from a cord extended over the top edge of a door and hanging downward where said door is mounted in a door frame in a room, and where said door has a top edge facing upward, a latching edge, an inside surface facing the interior of said room, with an upper portion thereof generally adjacent said top edge, an opposite outside surface, and a latch assembly with a latch bolt extendible outward of said latching edge, and said frame includes a strike plate for cooperation with said latch bolt, said apparatus operable with an electrically activated alarm, comprising:

a. an elongated pressure sensor when mounted on said inside surface of said door at said upper portion thereof able to activate said alarm, said sensor having a base part and an opposite exposed outer surface comprising a central portion and opposite side portions, said sensor being mountable with its base part generally parallel to and closely adjacent said inside surface of said door, and with said central portion of said sensor facing inwardly of said room when said door is closed, said exposed outer surface of said sensor:

(i) being responsive to force applied thereagainst by a segment of the cord when draped over said top edge of said door and hanging downward adjacent said inside surface and bearing laterally against said exposed outer surface of said sensor, and (ii) being adapted to forward a signal indicating the sensing of said force by said cord, and b. an electrical controller adapted to receive said signal from said sensor indicating that a downward force has been applied by said cord, and in response to receiving said signal to activate said alarm.

2. Apparatus according to claim 1 wherein said pressure sensor comprises a tubular body, that contains a pair of electrical contact strips which have a normal spaced apart relationship with at least one being movable to contact the other to close said electrical circuit with a resulting signal being sent to said controller.

3. Apparatus according to claim 1 wherein said pressure sensor is mounted at an elevation below said top edge of said door.

4. Apparatus according to claim 1 wherein said pressure sensor extends transversely away from said inside surface.

5. Apparatus according to claim 1 where said pressure sensor has an outer contact surface that faces upward and inward relative to said inside surface of said door.

6. Apparatus according to claim 1 wherein said pressure sensor has an upper surface that extends no higher than said top edge of said door.

7. Apparatus according to claim 1 wherein said pressure sensor has an external contact surface with normal position and an activated position that is inward or downward from said normal position, and a spring that resiliently urges said external contact surface forward of said normal position.

8. Apparatus for counteracting a suicide attempt of a person trying to hang himself from a cord extended over the top edge of a door and hanging downward where said door is mounted in a door frame in a room, and where said door has a top edge facing upward, an inside surface facing the interior of said room, with an upper portion thereof generally adjacent said top edge, and an opposite outside surface, said apparatus operable with an electrically activated alarm, comprising:

a. a door including a latch assembly and its latch bolt, b. a frame including a strike plate into which said latch bolt is moveable to latch said door, c. an unlatch unit mountable in said door frame and adapted to push said latch bolt out of said strike plate when said latch bolt extends in its locked position into said strike plate, and d. an elongated pressure sensor when mounted on said inside surface of said door at said upper portion thereof able to activate said alarm, said sensor having a base part and an opposite exposed outer surface comprising a central portion and opposite side portions, said sensor being mountable with its base part generally parallel to and closely adjacent said inside surface of said door, and with said central portion of said sensor facing inwardly of said room when said door is closed, said sensor having an exposed surface facing away from said inside surface, said exposed surface of said surface (i) being responsive to force applied there against by a segment of the cord when draped over said top edge of said door and hanging downward adjacent said inside surface and bearing laterally against said exposed surface of said sensor, and (ii) being adapted to forward a signal indicating the sensing of said force by said cord, and e. an electrical controller adapted to receive said signal from said sensor indicating that a downward force has been applied by said cord, and in response to receiving said signal (i) to activate said alarm, and (ii) to direct said latch assembly to push said latch bolt out of said strike plate so that said door can open.

9. Apparatus according to claim 8 wherein said unlatch unit comprises a housing mountable in said door frame adjacent said strike plate, and an electrically powered drive unit in said housing that pushes said latch bolt out of said strike plate when said controller receives said signal from said sensor.

10. Apparatus according to claim 9, further comprising a drive unit adapted to push said door open relative to said door frame after said controller has caused said unlatch unit to unlatch said door lock.

11. Apparatus for counteracting a suicide attempt of a person trying to hang himself from a cord extended over the top edge of a door and hanging downward where said door is mounted in a door frame in a room, and where said door has a top edge facing upward, an inside surface facing the interior of said room, with an upper portion thereof generally adjacent said top edge, and an opposite outside surface, operable with an electrically activated alarm, comprising:

a. an elongated pressure sensor when mounted on said inside surface of said door at said upper portion thereof able to activate said alarm, said sensor having a base part and an opposite exposed outer surface comprising a central portion and opposite side portions, said sensor being mountable with its base part generally parallel to and closely adjacent said inside surface of said door, and with said central portion of said sensor facing inwardly of said room when said door is closed, said sensor having an exposed surface facing away from said inside surface, said exposed surface of said sensor: (i) being responsive to force applied there against by the segment of a cord when draped over said top edge of said door and hanging downward adjacent said inside surface and bearing laterally against said exposed surface of said sensor, and (ii) being adapted to forward a signal indicating the sensing of said force by said cord, and b. an electrical controller adapted to receive said signal from said sensor indicating that a downward force has been applied by said cord, and in response to receiving said signal to activate said alarm.

12. Apparatus for counteracting a suicide attempt of a person trying to hang himself from a cord extended over the top edge of a door and hanging downward where said door is mounted in a frame in a room, and where said door has a top edge facing upward, a latching edge, an inside surface facing the interior of said room, with an upper portion thereof generally adjacent said top edge of the door frame when the doors closed, an opposite outer surface, and a latch assembly with a latch bolt extendable outward of said latching edge, said apparatus operable with an electrically activated alarm, comprising:

an elongated pressure sensor having a base part and an opposite exposed outer surface and being mountable generally parallel to and closely adjacent said inside surface of said door at said upper portion thereof, where the entire pressure sensor is situated at an elevation below said top edge of said door and said exposed outer surface is facing away from said inside surface of the door, said exposed outer surface of said sensor when said sensor is mounted on the door:

(i) being responsive to force applied there against by a segment of the cord when draped over said top edge of said door and hanging downward again adjacent said inside surface and bearing laterally against said exposed outer surface of said sensor, and (ii) being adapted to forward a signal indicating the sensing of said force by said cord, and an electrical controller adapted to receive said signal from said sensor indicating that a downward force has been applied by said cord, and in response to receiving said signal to activate said alarm.

13. A door alarm system for counteracting a suicide attempt of a person trying to hang himself from a cord extended over the top edge of a door and hanging downward where said door is mounted in a door frame in a room, comprising:

a. a door frame with a strike plate, b. a door that has a top edge facing upward, a latching edge, an inside surface facing the interior of said room with an upper portion thereof generally adjacent said top edge, an opposite outside surface, and a latch assembly with a latch bolt extendible outward of said latching edge for cooperation with said strike plate, c. an electrically activated alarm, and d. an elongated pressure sensor mountable generally parallel to and closely adjacent said inside surface of said door at said upper portion thereof, said sensor having a base part and an opposite exposed outer surface and being mountable on said inside surface of said door at said upper portion thereof, where the entire pressure sensor is situated at an elevation below said top edge of said door, said exposed outer surface of said sensor when said sensor is mounted on the door:

(i) being responsive to force applied thereagainst by a segment of the cord when draped over said top edge of said door and hanging downward adjacent said inside surface and bearing laterally against said exposed outer surface of said sensor, and (ii) being adapted to activate said alarm and forward a signal indicating the sensing of said force by said cord.

* * * * *